US007178897B2

(12) United States Patent
Huliba

(10) Patent No.: US 7,178,897 B2
(45) Date of Patent: Feb. 20, 2007

(54) METHOD FOR REMOVING LIQUID IN THE GAP OF A PRINTHEAD

(75) Inventor: David A. Huliba, Centerville, OH (US)

(73) Assignee: Eastman Kodak Company, Rochester, NY (US)

( * ) Notice: Subject to any disclaimer, the term of this patent is extended or adjusted under 35 U.S.C. 154(b) by 280 days.

(21) Appl. No.: 10/942,446

(22) Filed: Sep. 15, 2004

(65) Prior Publication Data

US 2006/0055726 A1 Mar. 16, 2006

(51) Int. Cl.
*B41J 2/165* (2006.01)

(52) U.S. Cl. ..... 347/28; 347/22; 347/24; 347/27; 347/23

(58) Field of Classification Search ..... 347/22–24, 347/27, 28
See application file for complete search history.

(56) References Cited

U.S. PATENT DOCUMENTS 4,323,908 A 4/1982 Lee et al.
4,563,688 A 1/1986 Braun
4,591,870 A 5/1986 Braun et al.
4,591,873 A 5/1986 McCann et al.
4,600,928 A 7/1986 Braun et al.
4,609,925 A 9/1986 Nozu et al.
4,800,403 A 1/1989 Accattino et al.
4,849,769 A 7/1989 Dressler
5,126,752 A * 6/1992 Weinberg ..... 347/28
5,202,704 A 4/1993 Iwao
5,475,411 A 12/1995 Strain et al.
5,541,628 A 7/1996 Chang et al.
5,543,827 A 8/1996 VanSteenkiste et al.
5,574,485 A 11/1996 Anderson et al.
5,650,802 A 7/1997 Suzuki et al.
5,682,191 A 10/1997 Barrett et al.
5,757,396 A 5/1998 Bruner
5,942,043 A 8/1999 Suemune
6,033,050 A 3/2000 Morita et al.
6,145,954 A * 11/2000 Moore ..... 347/28
6,168,256 B1 1/2001 Sharma et al.
6,183,057 B1 2/2001 Sharma et al.
6,183,058 B1 2/2001 Sharma et al.
6,196,656 B1 3/2001 Ghosh et al.
6,267,464 B1 7/2001 Furiani et al.
6,273,103 B1 8/2001 Enz et al.
6,286,929 B1 9/2001 Sharma et al.
6,290,323 B1 9/2001 Sharma et al.
6,350,007 B1 2/2002 Meichle et al.
6,609,780 B2 8/2003 Sugiyama
6,869,160 B2 * 3/2005 West et al. ..... 347/28
2001/0050696 A1 12/2001 Suzuki et al.
2002/0005873 A1 1/2002 Suzuki (Continued)

*Primary Examiner*—Shih-wen Hsieh
(74) *Attorney, Agent, or Firm*—The Buskop Law Group, P.C.

(57) ABSTRACT

A method for removing liquid in a gap of an ink jet printhead comprising a drop generator, with an outlet valve, orifice plate and charge plate, wherein a cross flush valve is additionally used to form a cross flush pressure in the drop generator, then actuators are used to vibrate the drop generator to a defined amplitude, then the outlet valve is closed to form a pressure spike in the drop generator then the pressure in the drop generator is lowered to a recommended operating pressure to establish a jet array and the system is operated until the gap is substantially free of liquid with dissolved residue.

19 Claims, 3 Drawing Sheets

U.S. PATENT DOCUMENTS

2002/0171704 A1 11/2002 Yonekubo et al.
2002/0186270 A1 12/2002 Sharma
2003/0071871 A1 4/2003 Yun
2003/0133842 A1 7/2003 Williams et al.

* cited by examiner

METHOD FOR REMOVING LIQUID IN THE GAP OF A PRINTHEAD

FIELD OF THE INVENTION

The present embodiments relate to an improved method for clearing ink from the gap between the orifice plate and the charge plate on ink jet printheads in continuous ink jet printing systems.

BACKGROUND OF THE INVENTION

Traditionally, the failure to remove residue in the gap of ink jet printheads that have a drop generator, orifice plate secured to the orifice plate forming a jet array, and a charge plate disposed opposite the orifice plate has resulted in operating error, such as an electrical short to the charge plate. Eventually, ink or other residue build-up can shorten printhead life or otherwise result in high maintenance costs caused by expenses for replacement parts and corresponding labor costs.

While a printhead shutdown sequence can remove the bulk of the liquid such as ink, from an ink jet printhead, some ink residue may be left on the exterior of the orifice plate and on the face of the charge plate. Such residues can result in misdirected jets or to specific electrical shorts between charging electrodes on the charge plate face. A need has existed for a method to remove such ink and other residues before using the printhead.

Startup processes or sequences that clear ink from printheads are taught in U.S. Pat. Nos. 4,591,870 and 4,591,873 that are incorporated by reference. These methodologies remove ink residues and to prepare the printhead for printing but these methodologies have not have the ability to be used on a continuous basis and only during startup. A need exists for other methods that can be used continuously with printhead use A need exists for an improved method of removing residue from an ink jet printhead during cross flush prior to and during the establishment of the continuous ink jet array to effectively clear the fluid, such as ink, from the gap between the orifice plate and the charge plate.

A specific need exists for 110 kHz 9-inch printheads operating with the high surface tension color inks (but not limited to those inks) for failures relating to "segment over current." These printheads have shown, over time, damage to the top surface of the charge plate coating and subsequent charge plate circuitry in the wetted footprint projected area of the orifice plate. "Segment over current" errors apparently occurred when excessive current was detected through any one or more of the 18-voltage segments comprised of the 42 IC chips. If charge plate circuitry is exposed to ink when charge voltage is applied, a high current draw will be detected and a "segment overcurrent" error will be displayed. This phenomenon occurs in the wetted area between the orifice plate and charge plate gap due to ink left in this area because of the breakdown of the dielectric strength of the charge plate coating thereby resulting in errors in the future. Accordingly, the present methods and systems were developed to address this specific problem.

Most situations of ink in the gap between the orifice plate and the charge plate have been cleared after first weeping ink in a cross flush state by closing the fluid outlet from the drop generator or a cross flush valve after the drop generator to create a water hammer pressure pulse that establishes the jets and pulls the excessive ink out of the gap. This method has problems in that the ink jet curtain is established too quickly to remove the ink effectively from the gap. A new method has been needed to slow the formation of the ink jet curtain to allow more time to clear the ink from the gap.

The present embodiments described herein were designed to meet these needs.

SUMMARY OF THE INVENTION

The embodied methods are for removing liquid, such as ink, from the gap between the orifice plate and the charge plate of a printhead. The method applies to printheads that include a drop generator that receives a liquid, such as an ink from a source or liquid supply. An orifice plate attached to the drop generator forms a jet array from a plurality of holes through which the liquid flows. A charge plate is disposed opposite the orifice plate forming a gap. A catcher is disposed adjacent the charge plate for catching drops that are not used for printing or other fluids passed through the drop generator. The printhead further includes a controller for optimizing the system. The new method uses one or more actuators are secured to the drop generator and a cross flush valve that are connected to the controller.

The method entails introducing a liquid to the drop generator at a cross flush pressure for cross flushing the drop generator and dissolving residue from the orifice plate and charge plate resulting in the formation of a liquid containing dissolved residue. Next, a signal is applied to one or more of the actuators that then vibrate the drop generator to a defined amplitude. The outlet valve attached to the outlet port of the drop generator is then closed to form a pressure spike in the drop generator. After the pressure spike, the pressure in the drop generator is lowered to a recommended operating pressure to establish a jet array. In a preferred embodiment, the recommended operating pressure is greater than the cross flush pressure. The one or more actuators continue to receive the signal until the gap is substantially free of liquid containing dissolved residue and the liquid with dissolved residue is removed using the catcher.

BRIEF DESCRIPTION OF THE DRAWINGS

In the detailed description of the preferred embodiments presented below, reference is made to the accompanying drawings, in which.

The present embodiments are detailed below with reference to the listed figures.

DETAILED DESCRIPTION OF THE INVENTION

Before explaining the present embodiments in detail, it is to be understood that the embodiments are not limited to the particular descriptions and that it can be practiced or carried out in various ways.

The embodied methods were designed to permit a printhead to have a longer life by providing a fast, easy system for removing liquid drop residue in the gap between the drop generator and the orifice plate in order to reduce maintenance problems for ink jet printheads.

The embodied methods were created to provide printheads for ink jet printers with increased versatility since the printheads using these methods are able to use a wider variety of inks with different surface tensions and ingredients without concern for incompatibility with the printhead as the methods allow the gaps to be cleared easily and economically, even with inks with higher viscosity or surface tension than inks traditionally recommended for the printhead without this feature.

Figure 1:
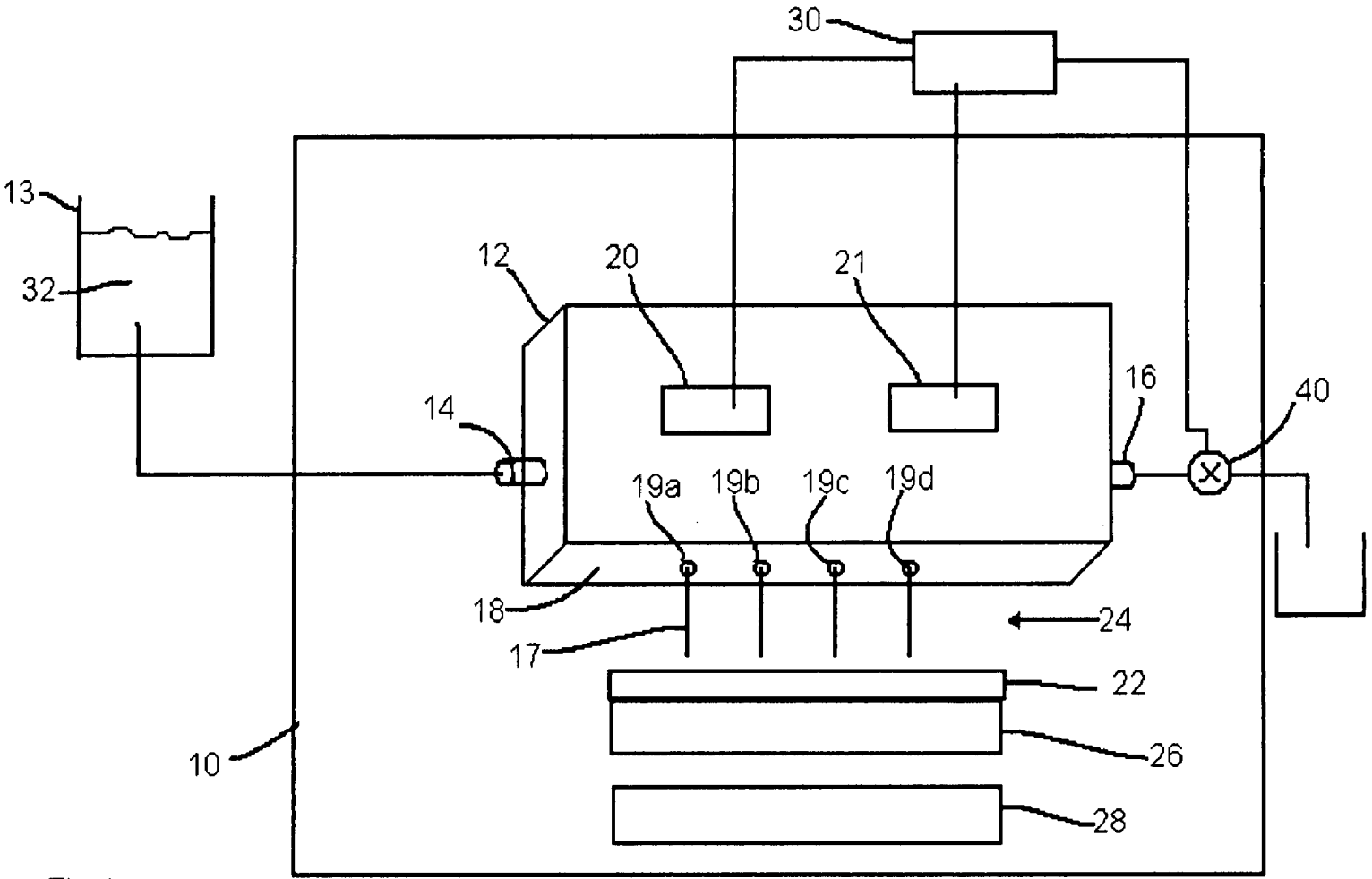
FIG. 1 depicts a cross section view of an ink jet printhead.

With reference to the figures, FIG. 1 shows a cross section view of an ink jet printhead 10. The printhead has a drop generator 12 that receives liquid, such as an ink from a source 13. In this embodiment, a liquid supply inlet 14 is shown on one side of the drop generator and a liquid outlet port 16 is on the other side. The liquid outlet port 16 is connected to an outlet valve 40. In a preferred embodiment, the outlet valve can be a solenoid valve, such as a diaphragm valve or a plunger type valve. Liquid 32 flows from source 13 to the liquid supply inlet 14.

An orifice plate 18 is attached to the drop generator and forms a jet array 17 using the liquid flowing through numerous holes 19*a*, 19*b*, 19*c*, and 19*d* that pierce the orifice plate. Typically a jet array can have between 32 jets and 6000 jets. The holes used to form the jet array can have a diameter ranging from 0.5 mils to 1.8 mils and in one particularly preferred embodiment between 0.88 mils and 0.94 mils.

One or more actuators 20 and 21 vibrate to the drop generator 12 to a defined amplitude based on a signal from a controller. A preferred signal for the actuator is between 50 kHz and 200 kHz and in one particularly preferred embodiment between 100 kHz and 115 kHz. In all of the embodiments of the method, the drop generator can be vibrated within 2% of the defined amplitude. Between two and twenty actuators can be used with a drop generator.

In a preferred embodiment, the actuators are disposed symmetrically around the drop generator, in an opposing relationship to each other. Preferably, the actuators are piezoelectric actuators, typically AC actuators. These actuators can be made of PZT compounds and bonded directly to the drop generator body, such as with a cyanoacrylate, an epoxy or other secure bonding material.

A charge plate 22 is disposed opposite the orifice plate 18 forming a gap 24 between the charge plate 22 and the orifice plate. The gap is very small. The charge plate 22 is typically coated a protective dielectric layer, such as an epoxy coating with a preferably screened onto the charge plate substrate.

A catcher 26 is disposed adjacent the charge plate 22 for catching liquid, namely drops, that are not used for printing from the drop generator. Typical catchers operate under a vacuum of between 10 inches of mercury and 16 inches of mercury and are available with the printheads from Kodak Versamark of Dayton, Ohio. U.S. Pat. No. 5,475,411 teaches an example of a printhead with a catcher and this patent is hereby incorporated by reference.

An eyelid 28 can be used to facilitate the catcher catching liquid containing dissolved residue produced by this method. Preferred eyelids are slightly longer than the jet array. Usable eyelids are made from metal with an elastomeric seal.

The printhead controller 30 connects to various pieces of equipment of this process, including the outlet valve and the actuators described above, and the controller is used to optimize a cross flush pressure through the drop generator, regulate the drop generator to operate above, below and at the recommended operating pressure, form a pressure spike in the drop generator, and control specifically, actuator vibration amplitudes for the drop generator. The fluid controller has a variety of components, such as those found in the Kodak Versamark printhead model PS 9100 printer.

In one embodiment of the method, a signal can be applied from the controller to the one or more actuator to vibrate the drop generator at a first defined amplitude. Next, the signal is reduced to produce a second defined amplitude and then increased back to the first defined amplitude. For this embodiment, the second defined amplitude can be up to 20% less than the first defined amplitude. A signal of 165 kHz can be a preferred signal applied to the actuators at a first amplitude of 106 millivolts. When the signal is reduced to the second defined amplitude, the signal can have an amplitude of 60 millivolts after which the amplitude is increased back to 106 millivolts.

In still another embodiment of the method, the signal can be applied to the one or more actuators to vibrate the drop generator to a first defined amplitude then the signal is increased to produce a second defined amplitude and finally lowered back to the first defined amplitude. For this embodiment, the second amplitude can be up to 20% more than the first defined amplitude. A signal of 165 kHz can be applied initially to the one or more actuators at a first amplitude of 60 millivolts. The signal is, then, increased to produce a second defined amplitude of 106 millivolts and then reduced back to 60 millivolts.

By creating this pressure spike, with the controllers, the residue in the gap is dissolved by the liquid pressure differentials to clear the gap between the orifice plate and the charge plate.

Figure 2:
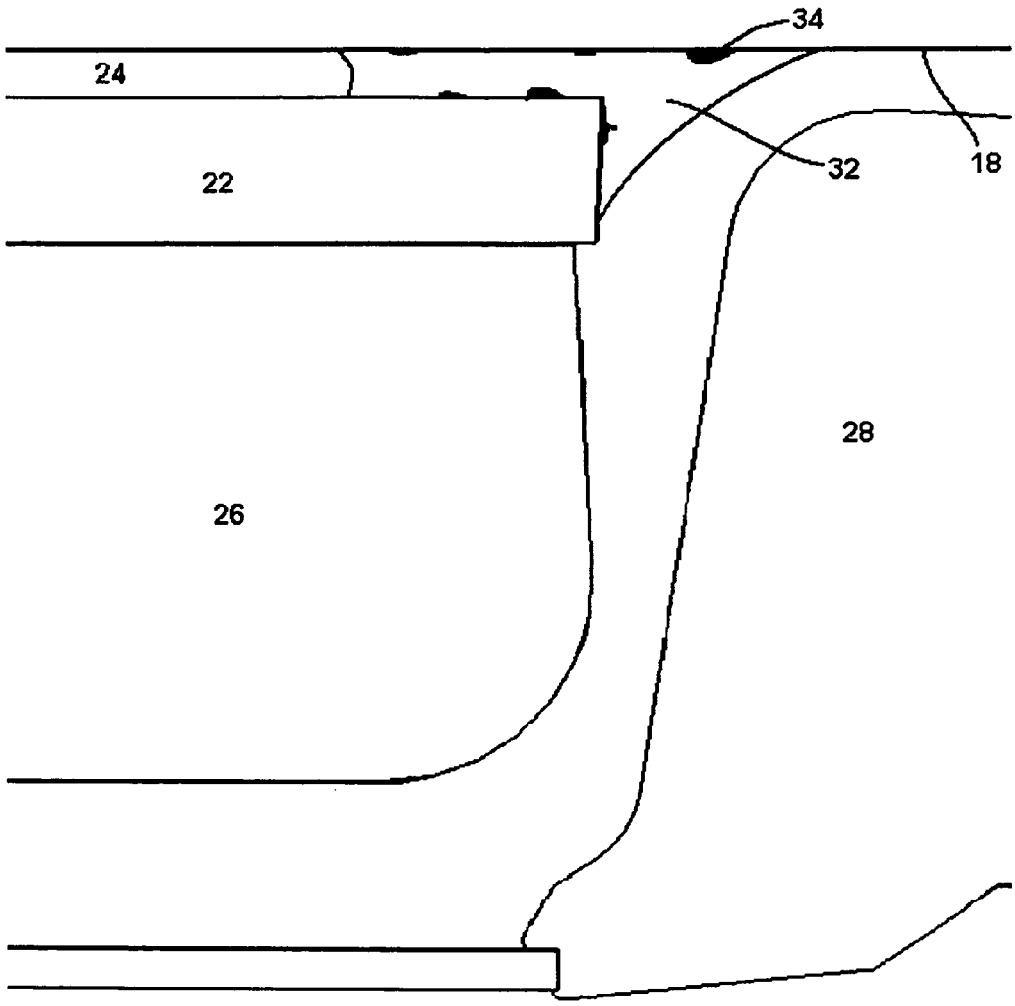
FIG. 2 depicts a detailed view of the orifice plate and charge plate area where the embodied methods have the greatest effect.

FIG. 2 is a detailed view showing the orifice plate 18 and charge plate 22 forming the gap 24 in which the liquid 32 collects. The liquid 32 is used to dissolve the residue 34 forming a liquid with dissolved residue. FIG. 2 shows the liquid with dissolved residue prior to falling past the catcher 26 and being removed from the printhead. Eyelid 28 can be used to facilitate the catcher operator and catch the liquid containing dissolved residue rather than passing the liquid with dissolved residue to the print media.

Preferred liquids usable in these methods can be aqueous based inks, such as Kodak Versamark FV 3003 black ink, Kodak Versamark FV 3004 yellow, Kodak Versamark FV 3002 magenta. Other liquids usable in these methods can be solvent based inks, polymer based inks, or cleaning fluids. The liquid additionally can contain a surfactant to reduce liquid surface tension, such as Kodak Versamark 3006 shut down fluid. Alternatively, the liquid can additionally contain a biocide to eliminate bacterial growth in the printhead, or an amine to control pH of the liquid, or combinations of thee surfactants, amines, and biocides.

Figure 3:
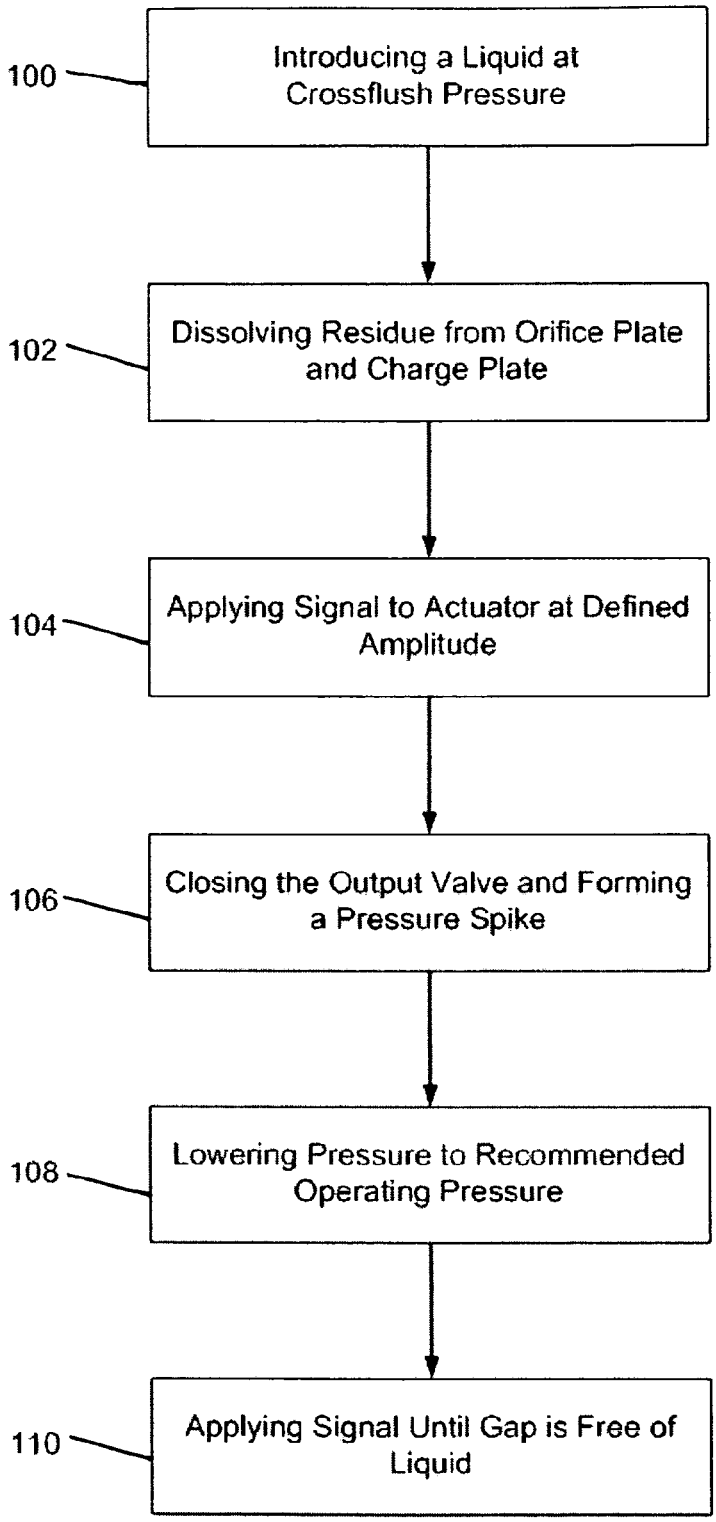
FIG. 3 is a flow diagram of an embodied method.

FIG. 3 shows a preferred method for removing liquid in a gap of a printhead. The method begins by introducing liquid to the drop generator to cross flush the drop generator at a cross flush pressure (Step 100).

Residue 34 is dissolved from the orifice plate and charge plate forming a liquid containing dissolved residue (Step 102).

A signal is applied to one or more an actuators to vibrate the drop generator of the printhead to a defined amplitude (Step 104).

An outlet valve 40 attached to the liquid outlet port 16 of the drop generator 12 is closed by a controller that enables the formation of a pressure spike in the drop generator (Step 106). The pressure spike can be up to two times the recommended operating pressure of the drop generator. For example, for a drop generator, such as in the printhead of a DH 92 model mentioned above, the recommended operating pressure is 35 psi. This method would call for a pressure spike is up to 70 psi within the drop generator for this model printhead.

Pressure in the drop generator is then lowered after the pressure spike to a recommended operating pressure to establish a jet array (Step 108). The recommended operating pressure is preferably greater than the cross flush pressure. An exemplary cross flush pressure for a DH 92 model is 2 psi.

The signal to the actuator is continued until the gap is substantially free of liquid with dissolved residue (Step 110). The liquid with dissolved residue is removed using the catcher, optionally using the eyelid.

The method can be used for situations where ink weeps from the ink jet printhead and re-wets the exterior of the charge plate and the face of the charge plate.

The increase of ink flow in front of the charge plate produces a siphoning action drawing ink out of the gap between the orifice plate and the charge plate.

Ideally, all the ink is removed from the gap between the orifice plate and charge plate using these embodied methods. The embodied methods provide a printhead with a gap that operates 90% free of liquid with dissolved residue.

As the printhead resolution is increased, the height of the gap ink must be reduced making removal from the gap more important.

Table 1 shows a representation of the different pressures usable with different ink jet printheads according to the embodied methods. Notably, Kodak Versamark printhead product numbers DH 90, DH 91, and DH 92 were used to create Table 1. The exampled printheads are available from Kodak Versamark of Dayton, Ohio. The pressures shown in Table 1 are all in psi (pounds per square inch).

TABLE 1

| Ink jet printhead | Weeping Pressure (psi) | Cross flush Pressure (psi) | Pressure Spike (psi) | Recommended Operating Pressure (psi) |
|---|---|---|---|---|
| DH90 | 0.4–0.6 | 0.8 | 25–40 | 15 |
| DH91 | 0.4–0.6 | 0.8 | 35–50 | 28 |
| DH92 | 0.4–0.6 | 2.0 | 45–65 | 35 |

In yet another alternative embodiment, a cross flush pressure can be used that is equal to or greater than liquid pressure in the drop generator causing liquid weeping from the orifice plate. The cross flush pressure is a value that is less than the amount of pressure needed to establish a jet array.

In an embodiment, the pressure spike can be greater than the cross flush pressure and can be up to two times the recommended operating pressure.

The recommended operating pressure of the drop generator can be increased or decreased up to 2 psi and still be usable within the scope of these embodied methods.

The embodiments have been described in detail with particular reference to certain preferred embodiments thereof, but it will be understood that variations and modifications can be effected within the scope of the embodiments, especially to those skilled in the art.

PARTS LIST

10 Printhead
12 Drop Generator
13 Source
14 Liquid Supply Inlet
16 Liquid Outlet Port
17 Jet Array
18 Orifice Plate
19*a* Hole
19*b* Hole
19*c* hole
19*d* Hole
20 (First) Actuator
21 Second Actuator
22 Charge Plate
24 Gap
26 Catcher
28 Eyelid
30 Controller
32 Liquid (Ink)
33 Cross Flush Pressure
34 Residue
35 Liquid With Dissolved Residue
40 Outlet Valve
100 Step of introducing a liquid at cross flush pressure
102 Step of dissolving residue from orifice plate and charge plate forming liquid with dissolved residue
104 Step of applying signal to actuator at defined amplitude
106 Step of closing the output valve and forming a pressure spike
108 Step of lowering pressure to recommended operating pressure
110 Step of applying signal until gap is free of liquid

The invention claimed is:

1. A method for removing liquid in a gap of a printhead, wherein the printhead comprises a drop generator comprising a liquid supply inlet and a liquid outlet port, an orifice plate attached to the drop generator for forming a jet array, an actuator secured to the drop generator, a charge plate disposed opposite the orifice plate forming the gap, and a catcher, wherein the method comprises the steps of:

a. introducing a liquid to the drop generator to cross flush the drop generator at a cross flush pressure to dissolve residue from the orifice plate and the charge plate forming a liquid containing dissolved residue;

b. applying a signal to the actuator to vibrate the drop generator to a defined amplitude;

c. closing an outlet valve attached to the liquid outlet port of the drop generator to form a pressure spike in the drop generator;

d. lowering pressure in the drop generator after the pressure spike to a recommended operating pressure to establish the jet array, wherein the recommended operating pressure is greater than the cross flush pressure;

e. continuing to apply the signal to the actuator until the gap is substantially free of liquid with dissolved residue; and f. removing the liquid with dissolved residue using the catcher.

2. The method of claim 1, wherein the gap is more than 90% free of liquid with dissolved residue.

3. The method of claim 1, wherein the printhead further comprises an eyelid for diverting the liquid containing dissolved residue into the catcher.

4. The method of claim 1, wherein the printhead further comprises a controller for optimizing the cross flush pressure, the recommended operating pressure, the pressure spike, and the vibration to the defined amplitude.

5. The method of claim 4, wherein the drop generator is vibrated within 2% of the defined amplitude.

6. The method of claim 1, wherein the cross flush pressure is equal to or greater than a pressure in the drop generator that causes liquid to weep from the orifice plate, and wherein the cross flush pressure is less than a pressure needed to establish the jet array.

7. The method of claim 1, wherein the pressure spike is greater than the cross flush pressure, and wherein the pressure spike is up to two times the recommended operating pressure.

8. The method of claim 1, wherein the recommended operating pressure is within 2 psi of the recommended operating pressure.

9. The method of claim 1, wherein the liquid is a member of the group consisting of an aqueous based ink, a solvent based ink, a polymer based ink, and a cleaning fluid.

10. The method of claim 1, wherein the liquid further comprises an additive, wherein the additive is a member of the group consisting of a surfactant to reduce liquid surface tension, a biocide to eliminate bacterial growth in the printhead, an amine to control pH of the liquid, and combinations thereof.

11. The method of claim 1, wherein the orifice plate comprises a hole diameter in the orifice plate ranging between 0.5 mils and 1.8 mils and, wherein the signal ranges between 50 kH and 200 kHz.

12. The method of claim 11, wherein the orifice plate comprises a hole diameter in the orifice plate ranging between 0.88 mils and 0.94 mils and, wherein the signal ranges between 100 kH and 115 kHz.

13. The method of claim 1, wherein the signal successively is applied to the actuator to vibrate the drop generator at a first defined amplitude, is reduced to produce vibration at a second defined amplitude, and is increased to produce a vibration at the first defined amplitude.

14. The method of claim 13, wherein the second defined amplitude is up to 20% less than the first defined amplitude.

15. The method of claim 1, wherein the signal successively is applied to the actuator to vibrate the drop generator to a first defined amplitude, is increased to produce a vibration at a second defined amplitude, and is lowered to produce a vibration at the first defined amplitude.

16. The method of claim 15, wherein the second defined amplitude is up to 20% more than the first defined amplitude.

17. The method of claim 1, wherein between two and twenty actuators are used to vibrate the drop generator.

18. The method of claim 17, wherein the actuators are disposed symmetrically on the drop generator and opposite each other on the drop generator.

19. The method of claim 1, wherein the actuator is a piezoelectric actuator.

* * * * *